United States Patent [19]

Billett et al.

[11] 4,392,600

[45] Jul. 12, 1983

[54] APPARATUS FOR MAKING PALLETS

[75] Inventors: Ronald J. Billett, Sunnyvale; Veikko K. Viitanen, San Jose, both of Calif.

[73] Assignee: FMC Corporation, Chicago, Ill.

[21] Appl. No.: 236,426

[22] Filed: Feb. 20, 1981

[51] Int. Cl.[3] ..... B27F 7/02; B42D 3/00

[52] U.S. Cl. ..... 227/50; 29/430; 29/432; 29/772; 227/100; 414/769

[58] Field of Search ..... 29/429, 430, 432, 772; 227/50, 40, 100, 48, 101, 104, 4

[56] References Cited

U.S. PATENT DOCUMENTS

| | | | |
|---|---|---|---|
| 3,557,439 | 1/1971 | Dykeman | 29/772 X |
| 3,591,067 | 7/1971 | Vial | 227/100 X |
| 3,642,116 | 2/1972 | Phillips | 414/769 |
| 3,706,408 | 12/1972 | Burch | 227/100 X |
| 3,954,170 | 5/1976 | Schlough | 414/760 X |
| 3,968,560 | 7/1976 | Vial | 29/430 |
| 4,054,236 | 10/1977 | Paxton | 227/50 X |
| 4,168,566 | 9/1979 | Streckert | 29/432 |

*Primary Examiner*—Charlie T. Moon

*Attorney, Agent, or Firm*—Louis J. Pizzanelli; Richard B. Megley

[57] ABSTRACT

An apparatus for making wooden pallets includes a conveyor for moving a plurality of parallel stringers under a nailing machine where deckboards are nailed transversely across the stringers to form one side of the pallet. During operation of the preferred embodiment, the gripping carriage of the stringer conveyor normally propels in front of it one set of stringers, on which three bottom deckboards have already been nailed to form a half-pallet, and pulls behind it a set of stringers that have had no deckboards at all nailed thereto. As the stringer of the half-pallet move under the nailing machine, five deckboards are nailed to its upper surface to complete the pallet and, when the trailing stringers move under the nailing machine, a set of three deckboards are nailed thereto to form a half-pallet. At a point downstream from the nailing machine, the full pallet is discharged and the gripper carriage starts to move rearwardly. During this rearward movement, the half-pallet is inverted and positioned on what is now the trailing side of the rearwardly moving gripper carriage. At a position on the upstream side of the nailing machine, the gripper carriage grasps a new set of stringers and starts forwardly again toward the nailing machine to have five top deckboards applied to the upper surface of the half-pallet to complete it, and have three deckboards nailed to the new set of trailing stringers to form a new half-pallet.

12 Claims, 29 Drawing Figures

FIG_12
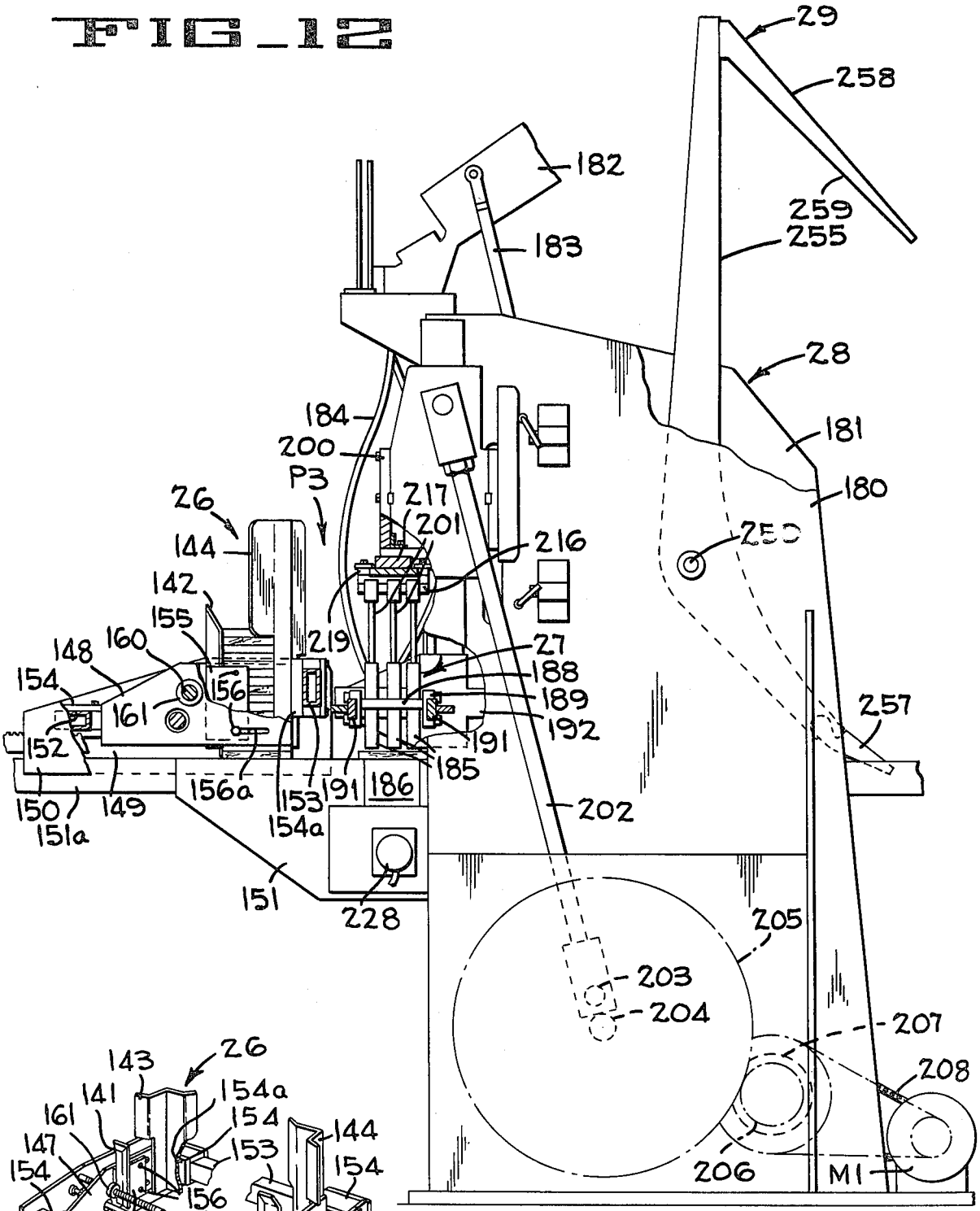
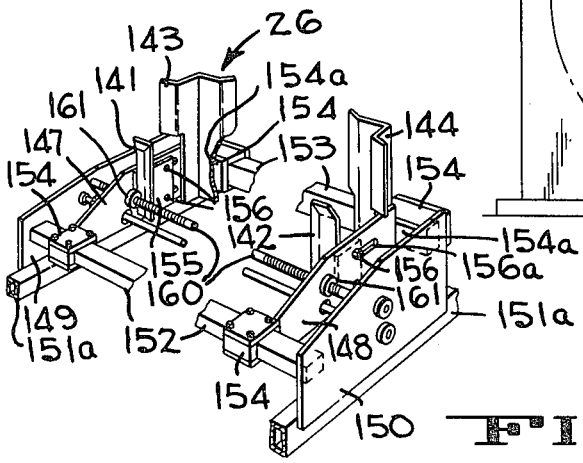
FIG_13

M1
M2
V1
V2
V3
V4
V5
V6
V7
V8
V9
V10
V11
20
20e
20f
20g
20h
21
22
22A
22B
24
25
29
40
50
51
53
60
61
62a
64
69
121
137
139
165
165a
166
167
168
169
170
192
193
200
201
202
203
204
205
206
208
226a
227
228
230
231
250
252
254
255
257
258
259
275
280
281
282
285
286
288
290
291
292
293
294
298
299
300

PALLET MAKING TASK

NAILER CONTROL TASK

CONVEYOR CONTROL TASK

ADD-A-BOARD TASK

DECKBOARD DELIVERY TASK

APPARATUS FOR MAKING PALLETS

BACKGROUND OF THE INVENTION

1. Field of the Invention

The present invention generally relates to a method of and apparatus for making pellets comprised of several stringers and deck boards on both sides of the stringers, such pallets being hereinafter referred to as double-faced pallets. The present invention more particularly relates to a method and apparatus for making double-faced pallets wherein deckboards are first attached to one side of several stringers to form a half-pallet, thereafter the half-pallet assembly is inverted, and deckboards are applied to the opposite sides of the stringers to form a double-faced pallet.

2. Description of the Prior Art

U.S. Pat. Nos. 3,557,439 to Dykeman and 4,054,236 to Paxton illustrate prior art apparatus for assembling double-faced pallets. The Dykeman patent discloses an apparatus that utilizes two nailing machines that are each adapted to drive nails vertically downwardly and a transfer device that is disposed between the nailing machines. The transfer device is adapted to turn over a half-pallet formed by the first nailing machine so that it may be fed in an inverted orientation to the second nailing machine. In the Dykeman system, the upstream nailing machine includes a jig adapted to receive stringers and hold the stringers in place in the desired parallel relationship. Deckboards are manually placed on the stringers within the jig, and then the jig is moved into a nailing station where nails are driven downwardly through the deckboards to fasten the deckboards to the stringers.

The Paxton U.S. Pat. No. 4,054,236 discloses an apparatus for making double-faced pallets which includes a single nailing machine and a conveyor that is adapted to concurrently support several stringers to which the bottom deckboards are attached and an inverted half-pallet assembly. Bottom deckboards are first attached to the several stringers at the nailing station and then the half-pallet assembly is returned to the deckboard loading position. The half-pallet is manually inverted at the loading position with the assistance of arcuate ramps that are adapted to lift one end of the half-pallet assembly from the conveyor on which the half-pallet is supported. After manually pivoting the half-pallet assembly and lowering it onto the pallet feeder of the nailing machine, the half-pallet assembly is advanced toward the nailing station and thereafter a further set of stringers is placed on the feeder conveyor. The Paxton U.S. Pat. No. 4,054,236 describes and claims a feeder conveyor that is adapted to support the empty stringers at a height such that the upper edges thereof to which the bottom deckboards are to be attached lies in the plane of the top edges of the stringers of the inverted half-pallet that is supported on the feed conveyor upstream from the empty stringers. The Paxton apparatus further includes a deckboard feeder adapted to automatically feed deckboards into nailing positions on the stringers. The apparatus of the Paxton machine is illustrated in trade literature published by S. W. F. Machinery, Inc. of Sanger, Calif. This trade literature, which is entitled "The Big Breakthrough in Faster Pallet Production", illustrates how two operators on opposite sides of the half-pallet turn the half-pallet which has been pivoted upwardly by arcuate ramps; the operators guide the pallet back into flight bars of the feeder conveyor with the bottom side down to return it to the deckboard nailing position.

SUMMARY OF THE INVENTION

The present invention provides a method and apparatus for making double-faced pallets that consist of spaced parallel stringers and several deckboards nailed to opposite sides of the stringers in spaced parallel relation and at right angles with the stringers. The apparatus includes a nailing machine adapted to consecutively nail deckboards to a plurality of spaced parallel stringers and a conveyor for intermittently conveying the stringers from a loading position forwardly toward the nailing station and thereafter in spaced relation to the nailing station to permit deckboards to be consecutively nailed to the stringers. After a first set of deckboards, usually the bottom deckboards, have been nailed to the stringers, the half-pallet assembly is completely inverted while it is conveyed on the conveyor. The apparatus for inverting the half-pallet assembly includes grippers, for releasably and firmly grasping one end of the half-pallet assembly, that are rotatably carried by the conveyor to permit the half-pallet to rotate about an axis that is transverse to the direction of travel of the conveyor. The inverting apparatus further includes a pivotable turn-over bar adapted to slidaly engage the free end of the half-pallet, and a pneumatic drive device for pivoting the turn-over bar synchronously with the movement of the conveyor.

DESCRIPTION OF THE DRAWINGS

FIG. 3 is a schematic end elevation of the machine taken looking in the direction of arrows 3—3 of FIG. 2.

FIG. 12 is a side elevation, with parts broken away, of the nailing machine used in the present pallet-assembly machine.

FIG. 13 is a fragmentary schematic isometric of the deckboard hopper mounted on the nailing machine of FIG. 12.

DESCRIPTION OF A PREFERRED EMBODIMENT

Figure 1:
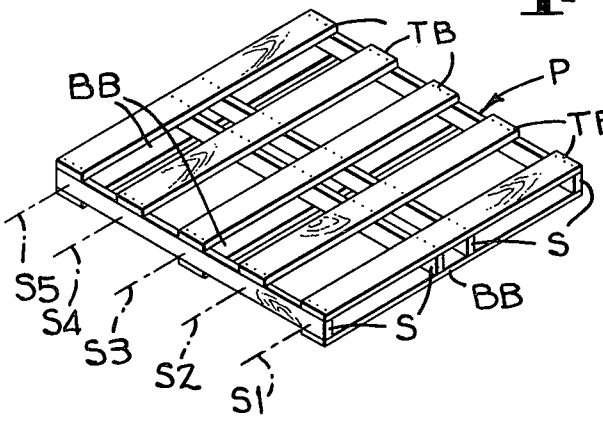
FIG. 1 is an isometric view of a pallet of the type that is fabricated by the machine of the present invention.

In FIG. 1 is illustrated a pallet P of a type that is fabricated by the machine of the present invention. The pallet comprises a series of spaced, parallel, longitudinally-extending stringers S to which a plurality of top boards TB and a plurality of bottom boards BB are nailed. The sequence followed by the machine in first nailing bottom boards to the stringers and then the top boards is schematically indicated in FIGS. 2A–2D. In general, at Station P1 the operator places the four stringers S in parallel position on a fixture 20 mounted on a roller carriage 21. A gripper head 22, which is carried back and forth in a horizontal path by a chain drive mechanism 24, is then moved to the left to Station P2 into gripping engagement with the leading edges of the two outermost stringers. The gripper head 22 is next moved to the right, pulling the carriage with it toward a nailing Station P3. An air motor drive mechanism 25 also urges the stringer carriage toward nailing Station P3 and, when the leading ends of the stringers reach that station, the gripper heads release the carriage and the drive mechanism 25 holds the carriage in a stationary position. A deckboard is moved forwardly from a hopper 26 and positioned on the leading ends of the stringers under a series of nailing chucks 27 of a nailing machine 28 which drive nails down through the deckboards and into the stringers. When the first deckboard has been nailed in place, the gripper head is again indexed to bring the middle sections of the stringers under the nailing chucks at Station P3 and a second deckboard is positioned on the stringers under the nailing heads and nailed to the sringers. This indexing movement of the gripper head and the positioning and nailing of deckboards is continued until the predetermined desired number of bottom deckboards has been nailed to the stringers. It will be noted that, during the indexing movement of the gripper head, the stringers are progressively pulled out of the stationary fixture 20 and the half-pallet is partially completed, the air motor drive mechanism 25 returns the stringer carriage and its fixture to Station P1 to receive another set of stringers.

When the last bottom deckboard has been nailed on the stringers, and the formation of a half-pallet has been completed, the gripper is moved to Station P5 at the end of its travel to the right. At this point the anvil is lowered by one deckboard thickness. The movement of the gripper head is then reversed and it pushes the half-pallet toward the left and through an inverting mechanism 29 at Station P4 at which the half-pallet is turned upside down. While the half-pallet is being inverted, the gripper head moves to a position ahead of the half-pallet and continues its movement toward the left. When it reaches Station P2 it engages with the new stringers that have been positioned there by the operator. When the stringers have been engaged, the gripper head moves toward the right to progressively move the stringers through station P3 where the five top deckboards are nailed thereon. The nailing anvil is raised by one deckboard thickness and the gripper head then moves the new stringers through Station P3 to have three bottom deckboards nailed thereon. When the gripper head reaches reversing Station P5, the completed pallet, which is moving along ahead of the gripper, is released by the gripper and moved onto a flat support surface 30 at the end of the frame of the machine by a conveyor 35. During its subsequent movement to the left, the gripper moves the half-pallet through the inverter at Station P4 and continues back to Station P2 to grip a new set of stringers put in place by the operator.

The pallet assembly machine comprises an elongate frame support structure 31 having spaced side walls 32 and transverse beams 33 extending between the side walls to form a rigid unitary structure. It will be noted that the upper surface 32*a* of the side walls are at one elevation from the infeed end of the machine to a point just past the nailing chucks 27 and that thereafter the surface 32*b* of the side members is at a higher evaluation. The stringer carriage 21 includes four rigid plates 20*a*–20*d* (FIGS. 3 and 4) secured together to form a rectangular frame, and four longitudinally-extending plates 20*c*–20*h* secured on the upper ends of angle brackets 20*i* and upwardly opening channel brackets 20*j*. A plurality of upwardly-opening U-shaped spring clips 39 (FIG. 3) are secured to the plates 20*e*–20*h* to form four lines of clips, the clips of each line being in alignment longitudinally to the machine. Four wheels 40 are mounted on the underside of the carriage, two on each side under the side plates 20*a* and 20*c*, and these wheels are arranged to roll along the upper surface of two spaced tracks 41 and 42. The tracks are mounted on the machine frame 31 and extend from the left end (FIG. 1) of the machine to a point just upstream from the deckboard hopper 26. The drive mechanism 25 which moves the carriage along the tracks 41 and 42 includes a pusher arm 50 (FIG. 5) carried on and projecting upwardly from the upper run of an endless chain 51. The arm 50 is secured at its upper end to an L-shaped angle 52 carried by the transverse member 20*b* of the carriage so that, when the upper run of the chain is driven to the right (FIG. 1), the lug will move the carriage to the right whereas, if the chain is driven to the left, the lug will push the carriage toward the left. The endless chain 51 (FIG. 3) is driven by an air motor 53 controlled through a solenoid-operated valve V1. A stop 54*a* carried by a transverse member of the frame of the machine limits the movement of the stringer carriage toward the left while a stop 54*b*, carried on each of the four longitudinal members 20*e*–20*h* of the carriage, act as positioning members for one end of each stringer.

Figure 2:
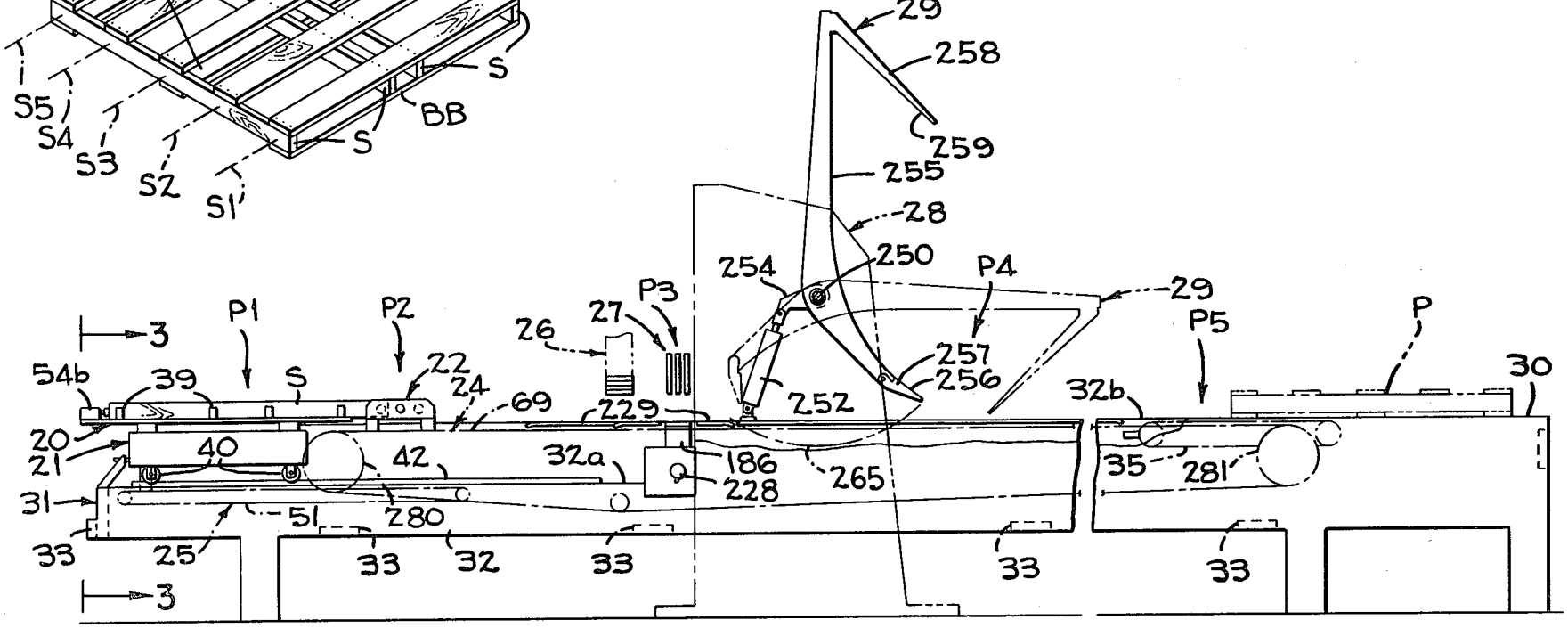
FIG. 2 is a schematic side elevation of the pallet-assembly machine.
Figure 2A:
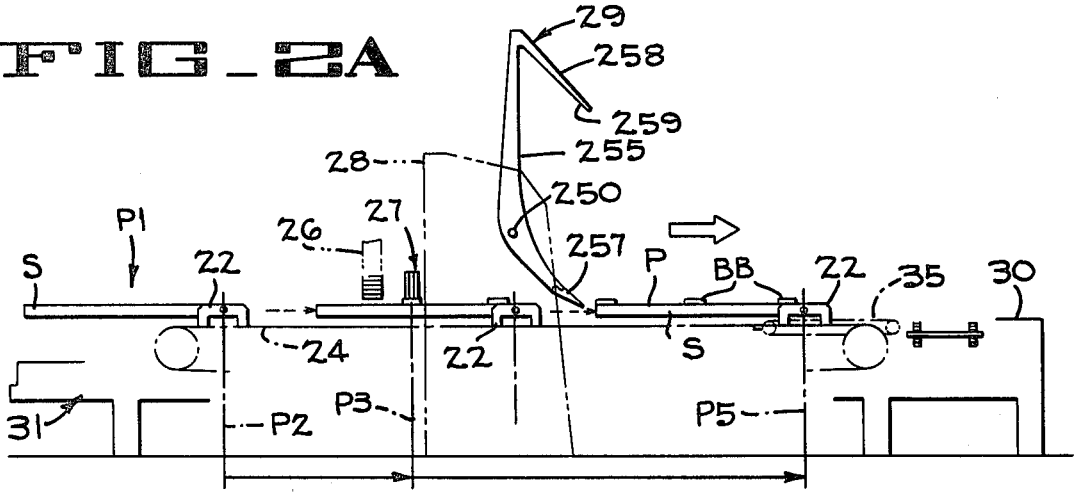
FIGS. 2A–2D are set of a diagrammatic partial side elevations of the machine, showing the sequence of operations that the machine performs in making pallets.
Figure 2B:
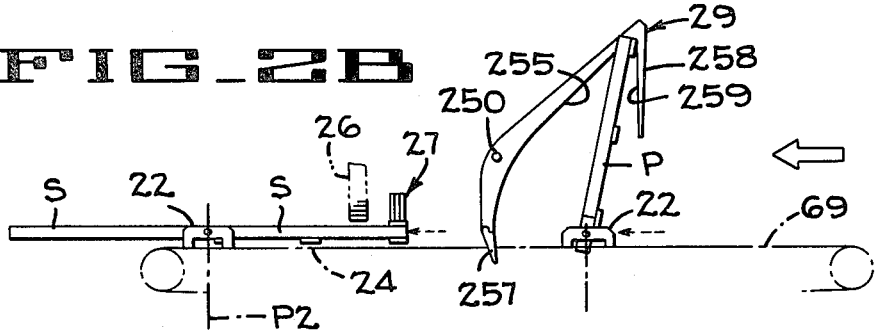
Figure 2C:
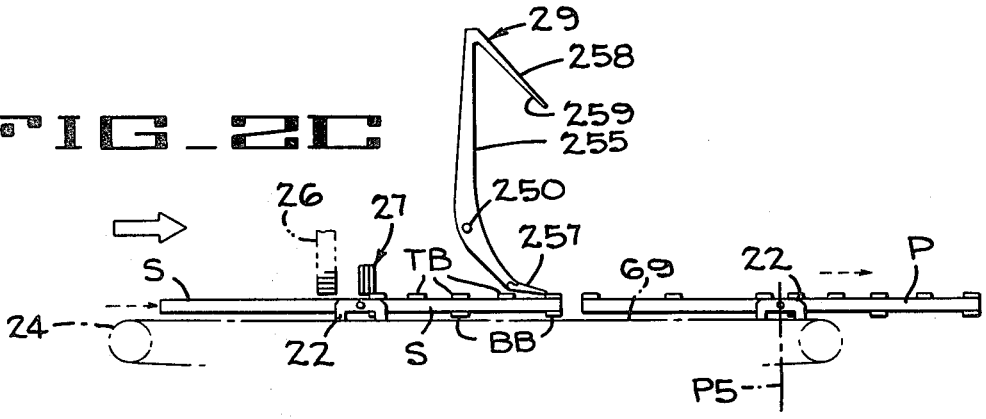
Figure 2D:
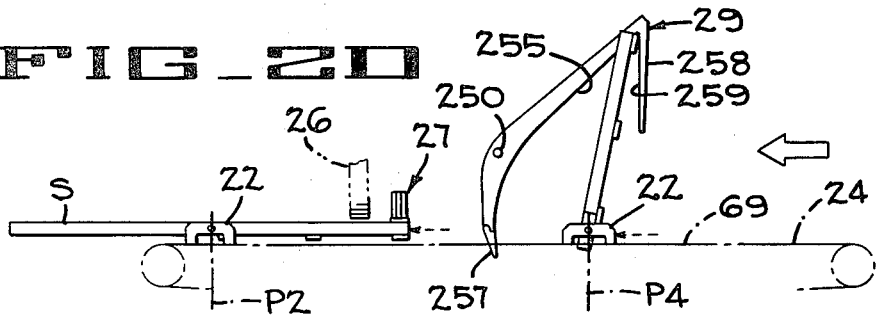
Figure 9:
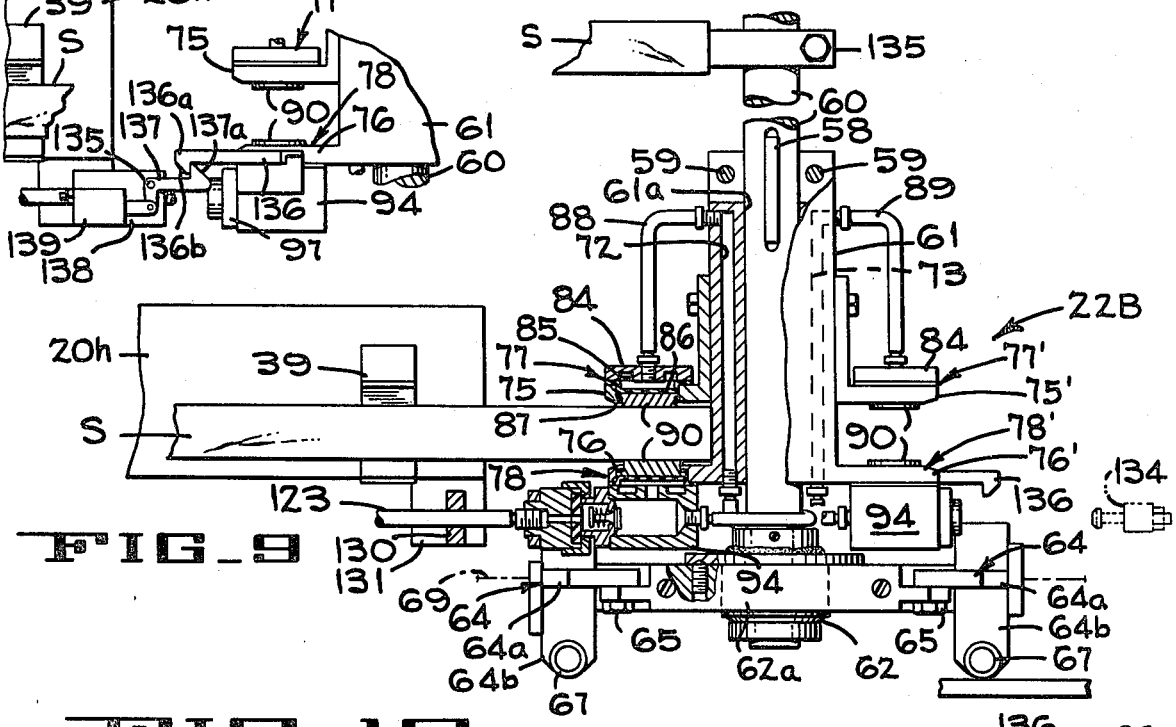
FIG. 9 is a fragmentary plan taken as indicated by line 9—9 of FIG. 7.
Figure 10:
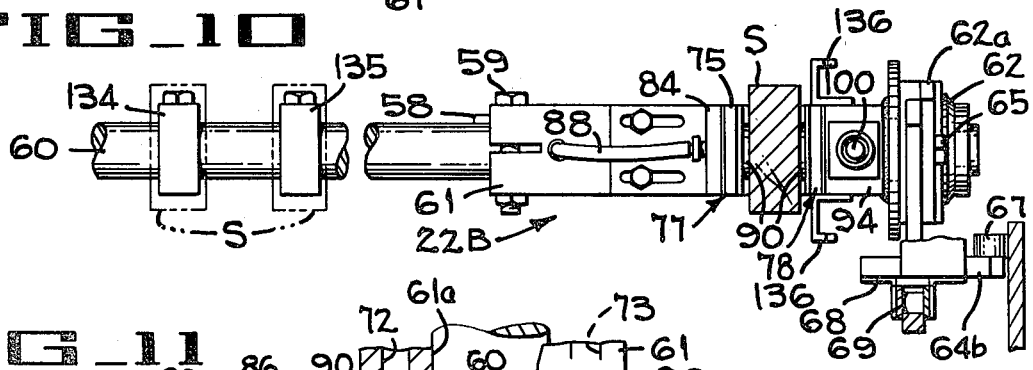
FIG. 10 is a fragmentary section taken on line 10—10 of FIG. 7.

The gripper carriage 22 is made up of two gripping heads 22A and 22B (FIG. 4) which are identical but oppositely disposed near opposite ends of a cross-shaft 60. Each of the units includes a cylindrical housing 61 connected by a key 58 (FIG. 9) and by clamping bolts 59 to the cross-shaft 60 that is rotatably journalled at each end in a bearing 62. Each bearing 62 is locked to a carrier bracket 64 by bolts 65 which secure each end of a plate 62*a* of the bearing assembly 62 to the carrier bracket. Each bracket 64 has an upstanding arm 64*a* and a laterally-extending arm 64*b* at right angles to arm 64*a* and carrying a roller 67 near its end. The arm 64*b* of each bracket 64 is mounted on a pair of angle links 68 (FIG. 10) of a drive chain 69 which, as seen in FIG. 2, extends from a point upstream of Station P2 to a point past Station P5.

Figure 11:
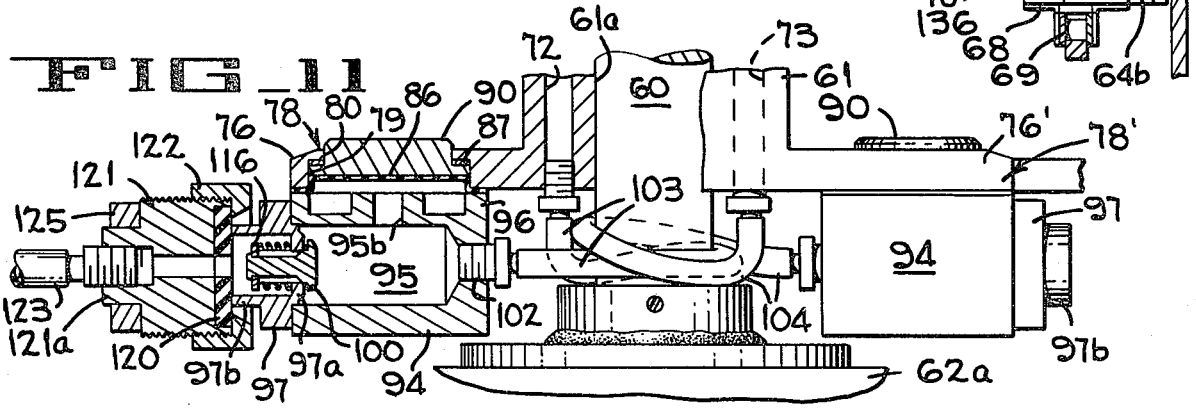
FIG. 11 is an enlarged view of a portion of FIG. 9.

The cylindrical housing 61 of each gripper unit has a central cylindrical opening 61*a* receiving the shaft 60 and a pair of passages 72 and 73. On one side, the housing 61 has two spaced flanges 75 and 76 projecting outwardly, the flange 76 being formed integrally with the housing 61 and the flange 75 being one arm of an angle secured to the housing. The flange 75 carries a gripper unit 77, and the flange 76 carries a gripper unit 78. Diametrically opposite the flanges 75 and 76 on the cylindrical housing 61 are identical flanges 75' and 76', respectively, the flange 75' carrying a gripper unit 77' and the flange 76 carrying a gripper unit 78'. Each of the four flanges has a cylindrical opening 79 (FIG. 11) concentric with a reduced diameter opening 80 adjacent one face of the flange. A plate 84 (FIG. 9) having an annular groove 85 formed therein is secured, by capscrews or the like, to each of the flanges 75 and 75' with the annular groove in confronting relation with the cylindrical opening 79 in the flange and providing a pressure chamber that is closed on one side by a rubber diaphragm 86 which is locked between the plate 84 and the flange. The passages 72 and 73 in the housing 61 communicate with the pressure chambers by conduits 88 and 89 respectively which are connected to fittings that are in flow communication with the passages and the chambers. A pressure pad 90 is positioned adjacent one face of each of the diaphragms 86 and is disposed for reciprocating movement in the cylindrical opening 79 provided by the associated flange. A wave washer spring 87 (FIG. 11) is positioned between the pressure pads 90 and the housings 75 and 76.

Similarly, a housing 94 is secured to each of the flanges 76 and 76' and each housing has one wall 96 provided with an annular groove which confronts the opening 79 in the adjacent flange and provides a pressure chamber which is bounded on one side by the diaphragm 86 that is carried by the flange. Each of the housings 94 is hollow and provides a central chamber 95 communicating respectively with the pressure chambers in the flanges 76 and 76' by a short passage **95*b***.

Each housing 94 is closed at one end by a cylindrical member 97 that is secured to the housing 94 and has an inwardly projecting flange **97*a* which provides a seat for a check valve 100. At one end the member 97 has a reduced diameter end 97*b*. A fitting 102 is connected in an end wall of each housing 94, one fitting communicating through a flexible conduit 103 with the passage 72 in the housing 61 and the other fitting communicating with passage 73 through flexible conduit 104. Each of the check valves 100 is urged to a closed position by a coil spring disposed around the stem of the valve between a snap ring 116 on the valve stem and the inwardly projecting flange 97*a***.

When a pair of gripper units, either 77, 78 or 77', 78' approach Station P2, the reduced diameter end of the leading housing 94 engages a rubber pad 120 that is held in a cylindrical recess in a cylindrical chuck 121 by a retainer ring 122. The rubber pad and the chuck 121 have aligned central passages that communicate with a flexible conduit 123 leading to a supply of pressurized air. The chuck 121 has a cylindrical end **121*a* that is pressed in a plate 125 (FIG. 7) which has a hole at each end that slidably receives a rod 127. Each rod 127 is locked by a nut 128 on a plate 130 which is secured to and projects upwardly from a lateral extension 131 of the stringer carriage 21. The plate 130 also slidably supports conduit 123. A coil spring 133 is disposed around each rod 127 between the plates 125 and 130. Just before the gripper units reach Station P2, the contact of the end of the housing 94 with the rubber pad 120 causes the chuck, the conduit 123, and the plate 125 on which the chuck is mounted to move slightly toward the left (FIG. 7) against the resistance of the springs 133. When the gripper units arrive at Station P2, a valve (to be described presently) in the control system establishes communication between conduit 123 and the source of pressurized air, causing the air to pass through the chuck and move the head of the check valve 100 off its seat. The pressure chambers adjacent the diaphragms 86 of whichever pair of opposed housings 84, 94 or 84', 94' is at Station P2 receive air and the chambers are expanded to urge the gripping pads 90 into gripping engagement with the two outermost stringers. One of the pads in each pair is slightly larger in diameter than its cooperating pad. Accordingly, when the gripper heads are subsequently moved toward the right (FIG. 1) and the stringer carriage is moved along with the heads, the leading ends of the four stringers are brought to a position at the nailing station P3. Also, when the gripper heads arrive at Station P2 the sides of the two housings 61 and two stops 132 and 132*a*, that are adjustably mounted on the cross bar 60** between the gripper heads, engage the ends of the four stringers and flush them into a common plane extending transversely of the machine.

Figure 8:
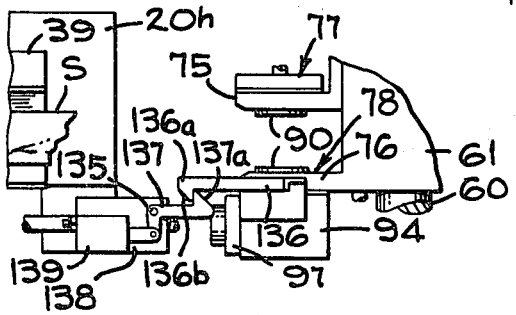
FIG. 8 is a fragmentary plan view taken looking in the direction indicated by arrows 8—8 of FIG. 7.

Referring to FIG. 8, a rigid latch bar 136 is mounted on each flange 76 and 76' of the housing 61 on the side of the flange that faces upwardly when that flange is at the stringer pick-up end of the machine. The latch bar has a laterally-projecting end **136*a* with a slanted leading edge 136*b* adapted to engage the slanted leading edge 137*a* of a latch lever 137 and pivot the latch lever 137 clockwise about a pin 135 that mounts the lever on an upper flat horizontal plate 138 which is secured to the upper end of the chuck-support plate 130. It will be evident that, as the gripper head moves toward the left (FIG. 8), the latch bar 136 will pivot the lever 137, and move past it as the head moves into engagement with the air chucks 121. Then, when the gripper heads again move toward the right, the latch bar will engage the latch lever and pull the stringer carriage with the gripper heads. When it is desired to release the gripper carriage from the gripper heads to permit it to return to the loading station, the lever 137 is pivoted clockwise by a solenoid 139 mounted on the plate 138**.

During an initial part of the operation when deckboards are being nailed on the stringers that trail the gripper carriage, the stringer carriage moves along with the gripper carriage and the gripper heads remain in engagement with the air chucks 121. During the deckboard-adding operation, the stringer table is moved rearwardly away from the gripper carriage to return to its initial position to receive another set of stringers. The check valve 100 of each gripper head is effective to lock a charge of air in the gripper head that holds the pads 90 in gripping engagement with a stringer all during the time that bottom boards are nailed to one side of the stringer to form a half-pallet, the half-pallet is moved rearwardly and inverted, and then moved forwardly again to have deckboards nailed to its other side. When the completed pallet reaches station P5, each of the two gripper heads that are advancing the pallet move into engagement with an abutment 134 that is shown in phantom lines at the right side of FIG. 9. The end **97*b* of the gripper head housing 94 telescopes over the abutment which engages and unseats the valve 100 to vent the gripper head and release the pallet so that the diverter conveyor 35 can discharge the pallet. The abutment 134 is shown in phantom lines in FIG. 9 since it is out of its actual location near the conveyor 35**.

The deckboard feeder comprises the deckboard hopper 26 made up of four upright angle members 141–144 (FIG. 13) which define the corners of the hopper. The angle members 141 and 142 are identical, only facing in opposite directions to define the forward inside corners of the hopper. Similarly, the members 143 and 144 are identical but oppositely disposed and define the rear corners. The corner members are positioned between two mounting plates 147 and 148 which, in turn, are positioned between two plates 149 and 150, each of which is secured to and projects upwardly from a member 151*a* of a side bracket 151 (FIG. 12) projecting from each side of the support structure of the nailing machine 28. Two box beams 152 and 153 are secured to and extend between the outer plates 149 and 150, and the inner plates 147 and 148 are adjustably slidable on these box beams by means of box-like collars 154, one of which is secured to both the forward and the rear ends of each of the inner plates. Each of the rear corner members 143 and 144 of the hopper is mounted on one of the members 154*a* of an adjacent collar 154 and, accordingly, the rear corner members 143 and 144 of the hopper are mounted for movement laterally of the machine with the inner side plates 147 and 148. On its outer face, each of the front corner members 141 and 142 carries a forwardly-extending plate 155 having holes arranged to receive bolts 156 therein, and each bolt extends through one of two slots 156*a* in the plate 147 or plate 148. Thus the front corner members are mounted directly on the plates 147 and 148 for adjusting movement toward and away from the rear corner members to vary the width of the deckboard hopper and for lateral adjustment with the rear corners to vary the length of the hopper. The inner plates 147 and 148 on which the corner members are supported are moved laterally of the machine on the box beams 152 and 153 by a feed screw 160 which is rotatably journaled in the outer side plates 149 and 150 and has oppositely cut threads at either end to engage nuts 161 mounted in each inner plate 147 and 148. When the feed screw is rotated, the plates 149 and 150 move toward or away from each other.

Figures 4, 5, 6, 7:
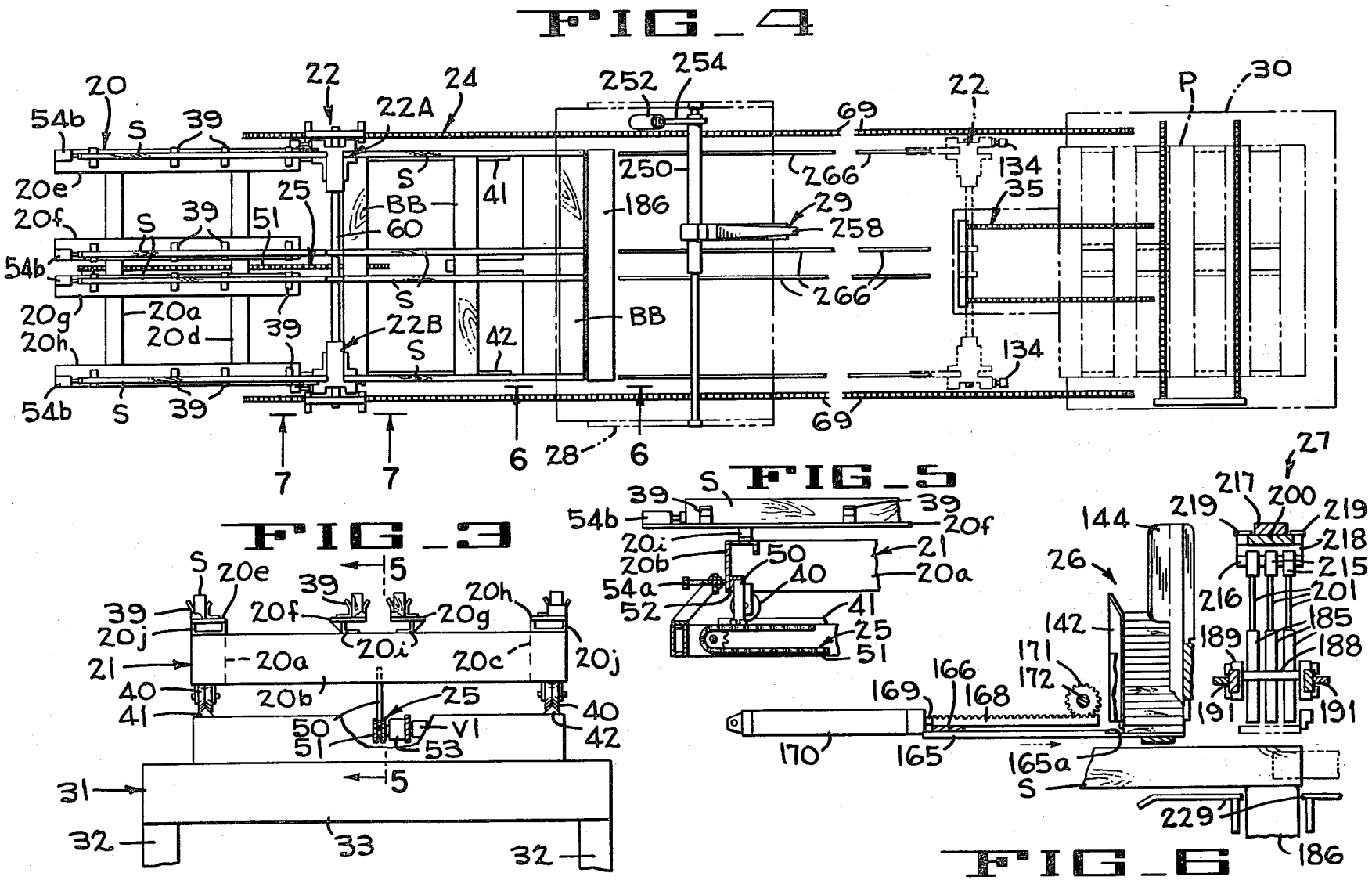
FIG. 4 is a schematic plan view of the machine.
FIG. 5 is a schematic section taken on line 5—5 of FIG. 3.
FIG. 6 is a fragmentary side elevation taken in the general area indicated by line 6—6 of FIG. 4.
FIG. 7 is a fragmentary side elevation taken along line 7—7 of FIG. 4, particularly showing the gripper carriage.
Figure 7:
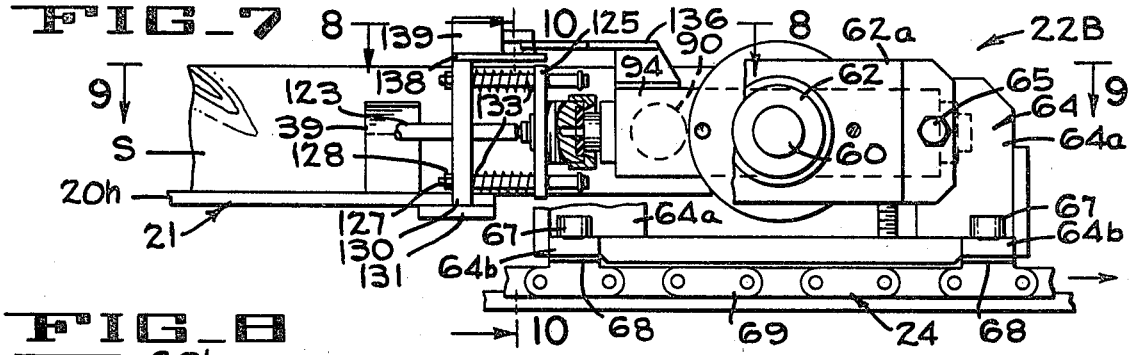

The bottom deckboard is removed from the hopper and fed forwardly to the nailing position by means of two stripper bars 165 (FIG. 14) which are carried on a connecting plate 166 that extends transversely of the machine and is connected at its ends to the underside of two racks 167 and 168. Each rack is carried on the outer end of the piston rod 169 of a double-acting pneumatic power cylinder 170 (one only being shown in FIG. 14). The movements of the two racks are coordinated by two pinions 171 that are keyed to a transverse shaft 172. As seen in FIG. 6, each stripper bar 165 has a forward surface and a rearward surface separated by a pusher shoulder 165*a*. When one end of each of the power cylinders is energized, each piston rod is projected out of the cylinder and the pusher shoulder 165*a* of the stripper bar engages the lowermost deckboard and pushes it out from under the stack and into a position under the chucks 27 of the nailing machine. As the stripper bars are moving forwardly to position a deckboard, the stack of deckboards move downwardly bringing the lowermost deckboard onto the forward surfaces of the stripper bars rearwardly of the pusher shoulders 165*a*. Then, when the other ends of the power cylinders are energized, the stripper bars 165 move rearwardly, causing the lower edges of the rear corner members 141 and 142 of the hopper to strip the deckboard from the upper surfaces of the bars and causing it to assume a position forwardly of the pusher shoulders 165*a* when the stripper bars come to rest in its retracted position.

The nailing machine 28 is of the type disclosed in the Richards U.S. Pat. No. 2,856,606 with certain changes in the mounting of the nail chutes, the nail punches, and the anvil against which the pallets are nailed. In all other respects the present nailer 28 follows the teachings of the Richards patent which is incorporated herein by reference.

In general, the nailer comprises a support structure which includes a pair of support walls 180 and 181 (FIG. 12). A shaker type nail feed mechanism is mounted at the upper end of the support structure and includes a nail hopper 182 which is continuously oscillated in a vertical direction by a rod 183 connected to a crank. Nails are directed from the hopper into a plurality of parallel downwardly-inclined runways each of which has a rotary nail pick at its lower end for removing nails one by one from the runway and dropping them into a funnel for delivery through a tube 184 to a nail chuck 185 disposed in spaced relation above an anvil 186. In the Richards machine there are twelve nail-picking units disposed in side-by-side relation across the machine for directing nails into twelve chucks which are also disposed in side-by-side relation extending across the machine. In the present machine, there are twelve nail-picking units disposed side-by-side exactly as in the Richards machine, however, the nail chucks 185 are arranged in four units each having three chucks disposed in a line extending longitudinally of the machine in a manner to be described presently. The tubes extending between the funnels of the nail-picking units to the chucks are made of a suitable length and bent to accommodate the longitudinal disposition of the chucks.

Figure 14:
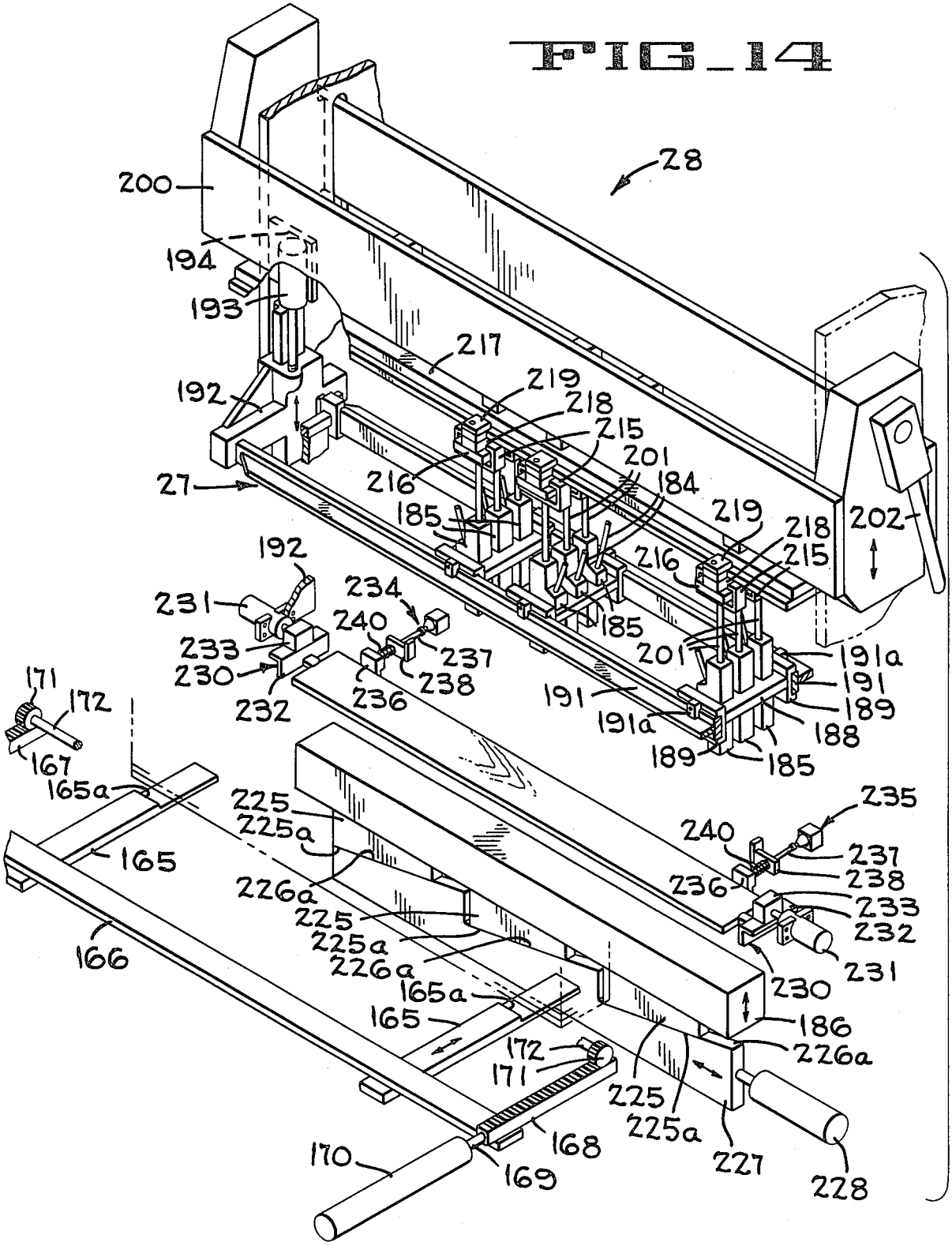
FIG. 14 is an exploded fragmentary isometric view of parts of the nailing machine of FIG. 12
Figure 15:
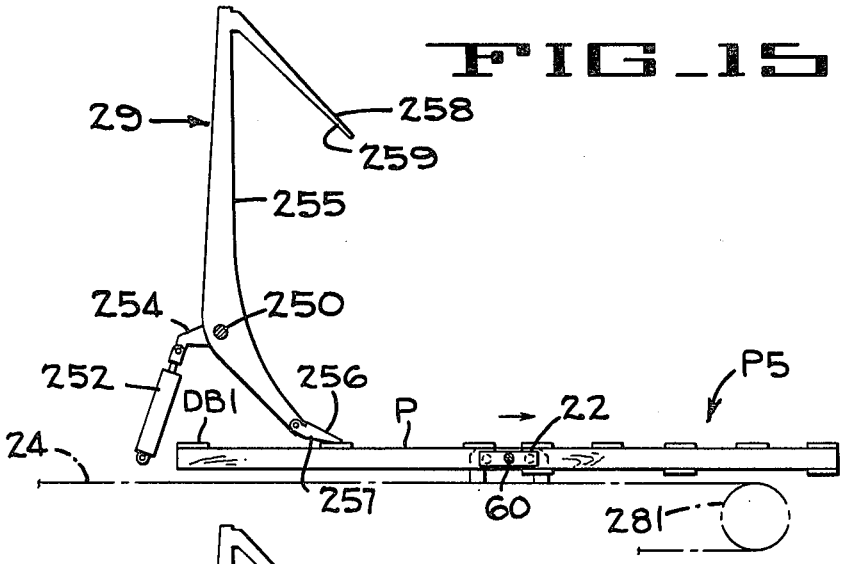
FIGS. 15–19 are diagrammatic views showing consecutive positions of the half-pallet turn-over bar of the pallet-assembly machine.

In FIG. 14, three of the four chuck units are shown, one being omitted to show other structure. Each unit comprises a plate 188 in which three chucks are mounted in upright position. At each end the plate 188 has a U-shaped slide 189 and each slide is disposed on a transverse bar 191 and is locked thereon by a releasable clamp 191*a*. Each of the transverse bars 191 is secured at each end in an end plate 192 (one only being shown in FIG. 14). Each end plate is raised and lowered by means of a double-acting pneumatic power cylinder 193, each cylinder being mounted on a plate 194 secured to and extending inwardly from one of the side walls 180 or 181 of the machine.

The nails are forced out of the chucks and into the deckboards and stringers by a vertically reciprocable nail-driving head 200 (FIG. 14) which carries twelve punches 201 (nine only being shown), each punch being adapted to pass downwardly into one of the chucks to contact the head of the nail therein. The nail-driving head is reciprocated in a vertical direction by a rod 202 (FIG. 12) connected to a power-driven crank 203. Crank 203 is rotated by a shaft 204 which is driven, through meshing gears 205, 206, a selectively-operable electrically-actuated clutch-brake unit 207, and a chain drive 208, by a continuously operating electric motor M1.

In the Richards machine, the twelve nail punches are mounted in side-by-side relation to move downwardly through the twelve side-by-side chucks. In the present machine, the twelve punches 201 (FIG. 14) are mounted in four groups of three generally longitudinally-aligned punches and are disposed directly above the grouped chucks 185 therebelow. Each of the punches has a bracket 215 at its upper end which has inwardly extending arms overlying the opposite side edges of a short plate 216 that extends under a horizontal plate 217 connected to the nail-driving head 200. Each plate 216 has a short bar 218 secured to and extending along its upper surface, and each bar 218 is adjustably clamped to the horizontal plate 217 of the driving head 200 by a clamp 219. Accordingly, it is evident that each group of three nail punches can be easily aligned over a group of three chucks for movement down through the chucks as the head 200 is moved downward and up out of the chucks when the head is lifted.

The anvil 186 is mounted directly below the nailing chucks and comprises a steel bar of generally square cross-section having three lift plates 225 secured in a line longitudinally of the anvil to the undersurface of the anvil. Each lift plate has an inclined lower surface 225*a* that engages one of three oppositely inclined surface 226*a* on an actuator bar 227 carried on the end of a double-acting power cylinder 228. The anvil 186 is supported and guided in the support structure of the machine for movement in a vertical direction, and the actuating bar 227 is supported and guiding for movement in a horizontal direction under the urging of power cylinder 228. Referring to FIG. 6, it will be noted that, when new stringers are advanced to nailing position P3 they have no deckboards on their lower side. Accordingly, at this time, the anvil 186 is raised enough to support the stringers. When a half pallet moves through the nailing position, it has deckboards on its lower side and the anvil then remains in its lowered position with its support surface flush with the surface of two support plates 229 that extend across the machine.

During the nailing operation the deckboard is held between two clamps 230 (FIG. 14), each of which is actuated by a double-acting pneumatic power cylinder 231 that is mounted on the frame 192 of the chuck assemblies. Each clamp comprises a board-engaging member that has a flattened outer end and is welded at its inner end to an angle bar 232 that carries a block 233 on its upper surface. The block is secured to the outer end of the piston of the associated power cylinder. Since the power cylinders that carry the clamps 230 are mounted on the frame of the chuck assemblies, they move up and down with the chuck assemblies.

A pair of deckboard stops 234 and 235 are also mounted on the chuck assembly frame 192. Each stop includes a block 236 carried on a rod 237 that is slidable in a bracket 238 which is secured to frame 192. A coil spring 240, freely disposed on the rod 237 between the block 236 and the bracket 238, cushions the impact of the leading edge of the deckboard against the stop block 236.

The pallet turnover bar 29 is pivotally mounted substantially midway between the walls 180 and 181 on a rod 250 which is rotatably mounted in bearings carried by the walls and projects through wall 181. The bar is movable, between the upright half-pallet intercepting position shown in solid lines in FIG. 2 and the half-pallet depositing position shown in phantom lines, by a double-acting pneumatic power cylinder 252 which is mounted on the outside of wall 181 between a lateral support plate, that is connected to the frame structure of the machine, and an arm 254 keyed to the part of rod 250 which extends outwardly past the wall 181.

The turnover bar 29 is a steel member having a main body portion with a forward flat face 255, that is about two inches wide, extending for its full length including the surface 256 of an arm 257 that is pivotally mounted on the lower end of the bar and a beak portion 258 of the bar 29, the inner face 259 of which extends generally outwardly and rearwardly from the face 255 of the main portion of the bar at an angle of about 60 degrees. The arm 257 and the bar have abutment surfaces which permit the arm to pivot counterclockwise from the position shown in FIG. 2 but not clockwise.

Figure 16:
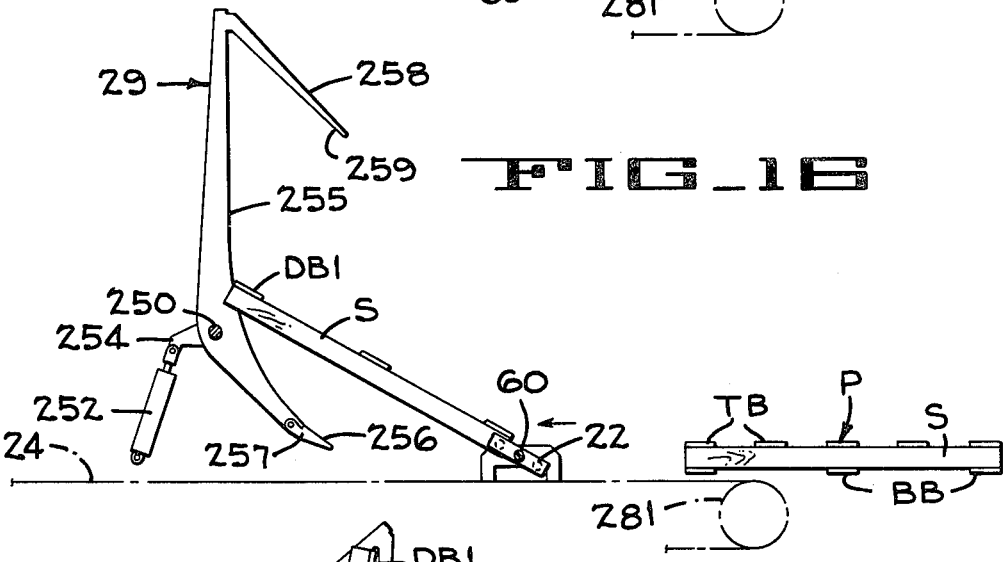

The action of the turnover bar is shown in FIGS. 15–19. It will be noted in FIG. 15 that when the gripper carriage moves toward the right to push a completed pallet to the discharge station P5, the deckboards on the leading pallet and on the trailing half-pallet engage the arm 257 and pivot it upward as they pass thereunder to obtain clearance. Then, after the full pallet has been released and the half pallet is being pushed rearwardly, the deckboard DB1 at the leading end of the half pallet engages the guide surface of arm 257 and rides up the surface as seen in FIG. 16. When the deckboard DB1 reaches a position approximately halfway between the pivot rod 250 and the point where the surface 255 of the main body portion of the bar meets the surface 259 of the beak portion, the power cylinder 252 is actuated to extend the piston rod to pivot the bar clockwise about rod 250. The speed of pivoting of the turnover bar is coordinated with the speed of upward movement of the deckboard DB1 so that the half pallet is progressively pivoted clockwise as the two gripper carriages rotate about shaft 60. After the deckboard DB1 reaches the point where the guide surfaces 255 and 259 meet each other and the deckboard starts to move along a downwardly descending arc, it moves into engagement with the guide surface 259. During continued rotation of the gripper carriage as it moves rearwardly, the deckboard DB1 slides down the guide surface 259 and is eventually deposited relatively gently on the guide channels. It will be evident that the timing of the pivoting movement of the bar must be such that the arm 257 at its lower end will be raised high enough to permit the half pallet to pass under it. The bar is held in the clockwise pivoted position until the entire half pallet has moved past the arm 257 after which it is returned to the position of FIG. 2.

Figure 17:
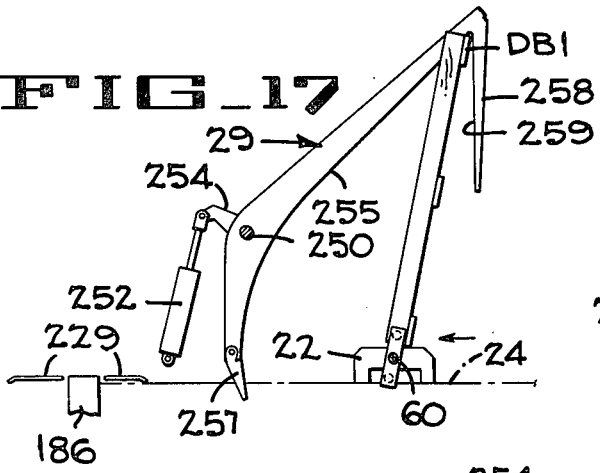
Figure 18:
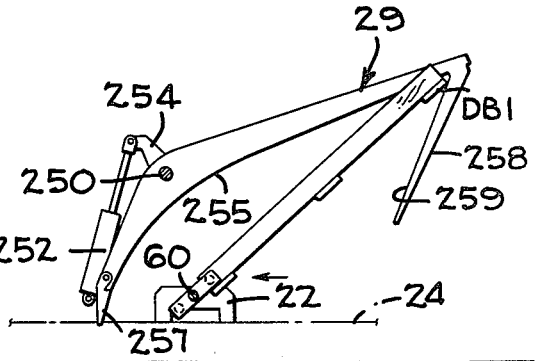
Figure 19:
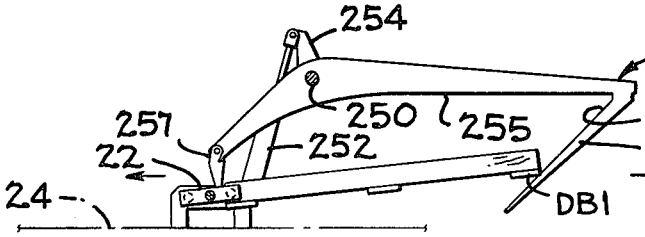

In FIG. 2 the arcuate center line 265 below the turnover bar 29 indicates that, during the clockwise pivoting movement of the bar, the lower end of the arm 257 passes below the plane of the upper surfaces of the two support plates 229. Accordingly, no plates that extend across the machine can be located at the area. Similarly, as seen in FIG. 17, parts of the gripper head 22 also pass below the plane of the support plates 229. To provide support for the outer ends of the half pallets and full pallets being advanced by the gripper carriage after these end portions leave the last support plate 229, four narrow bars 266 (FIG. 4) are mounted on the downstream side of that support plate. The upper surfaces of these bars are in the horizontal plane of plates 229, and they are mounted on the frame structure of the machine in any suitable way, and are narrow enough to support the stringers without interferring with the grippers as they pass below the plane of plates 229, the pads of each gripper head being spaced apart a distance greater than the width of each bar.

Figure 20:
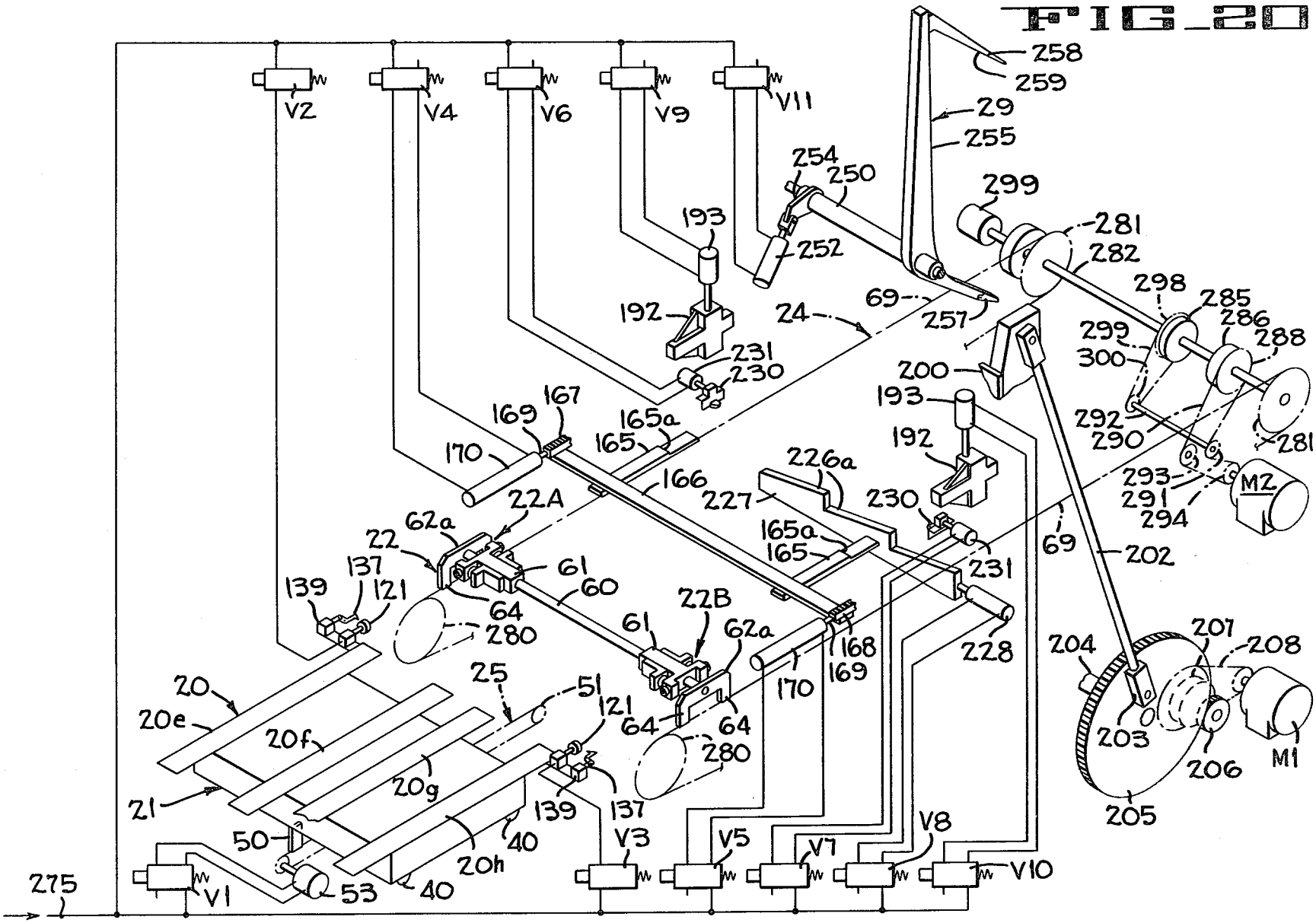
FIG. 20 is a diagrammatic view showing several of the drive mechanisms and the valves and solenoids for controlling their operation.

In FIG. 20 the drive mechanisms of the machine and several of the control devices are illustrated. As mentioned previously, the stringer roller carriage 21 is actuated by an air motor 53 which is controlled by a valve V1 connected to an air supply header. The air chucks 121 receive air from the header 275 through valves V2 and V3. The solenoids 139 that actuate the latches 137 to release the stringer carriage from the gripper carriage are connected to a suitable source of electrical power. The cylinders 170 that move the stripper bars of the deckboard feeder back and forth are connected to the air supply header through valves V4 and V5. Valves V6 and V7 control the cylinders 231 that actuate the deckboard clamps 230. A valve V8 is connected between the header and the cylinder 228 that raises and lowers the nailing anvil by means of the slide bar 227 which has the inclined camming surfaces 226*a*. The cylinders 193 which raise and lower the nailing chucks through the end plates 192 of the chuck unit are connected through valves V9 and V10 to the header. A valve V11 connects the cylinder 252 of the half-pallet inverting bar 29 to the header. The motor M1 that cycles the nailing head by means of the connecting rod 202 is connected to a source of electric power, as is the motor M2 that drives the gripper carriage through the endless chains 69 of the drive mechanisms 24. The chains 69 are trained around sprockets 280 journaled on a cross shaft (not shown) and two sprockets 281 keyed to a drive shaft 282. Two electrically-operated clutch-brake units 285 and 286 are disposed on the shaft 282, each unit having an output member keyed to the shaft and an input sprocket freely rotatable about the shaft and arranged to be moved into gripping engagement with the associated output member to rotate with it. The input sprocket 288 of unit 286 is driven in one direction by the Motor M2 by means of a chain 290 that is trained around the sprocket 288, a sprocket 291 keyed to a countershaft 292, an idler sprocket 293, and a sprocket 294 keyed to the motor shaft. The input sprocket 298 of unit 285 is driven in the direction opposite to the direction of rotation of the input sprocket 288 by a chain 299 trained around the sprocket 298 and a sprocket 300 keyed to countershaft 292. If unit 286 is considered to be the forward drive unit and unit 285 is considered to be the reverse drive unit, when unit 286 is engaged, the gripper carriage is moved forwardly and when unit 285 is engaged the gripper carriage will move rearwardly.

The general operation of the present pallet-making machine has been described in connection with FIGS. 2A–D. A detailed description of the start-up cycle of the machine and the cycle immediately following will be described in connection with FIGS. 21–25 which are state diagrams representing the sequence of states that the computer program goes through in carrying out the various operations. During the discussion, reference will be made to stringer sections S1–S5 which, as indicated in FIG. 1 by transverse phantom lines, correspond to consecutive sections along the length of the stringers at which deckboards are nailed.

The program of the present pallet maker is supported by various routines that are not applications oriented and that are designed specifically to support programs designed with the state machine concept, that is, a state, input driven program. Some of the routines are subroutines while others form a module that creates a simple real-time environment under which state machines can operate.

In general, a state machine is a process or task which can process a sequence of inputs or messages as they arrive. These messages can cause different results depending on the state of the machine. A state machine reacts to an input in a certain manner as a result of all prior inputs to it, and tasks that are designed and implemented to use the state machine concept need to operate in a fashion that permits delivery of input messages (software) from the external environment and from other tasks without the necessity of polling for inputs.

Figure 21:
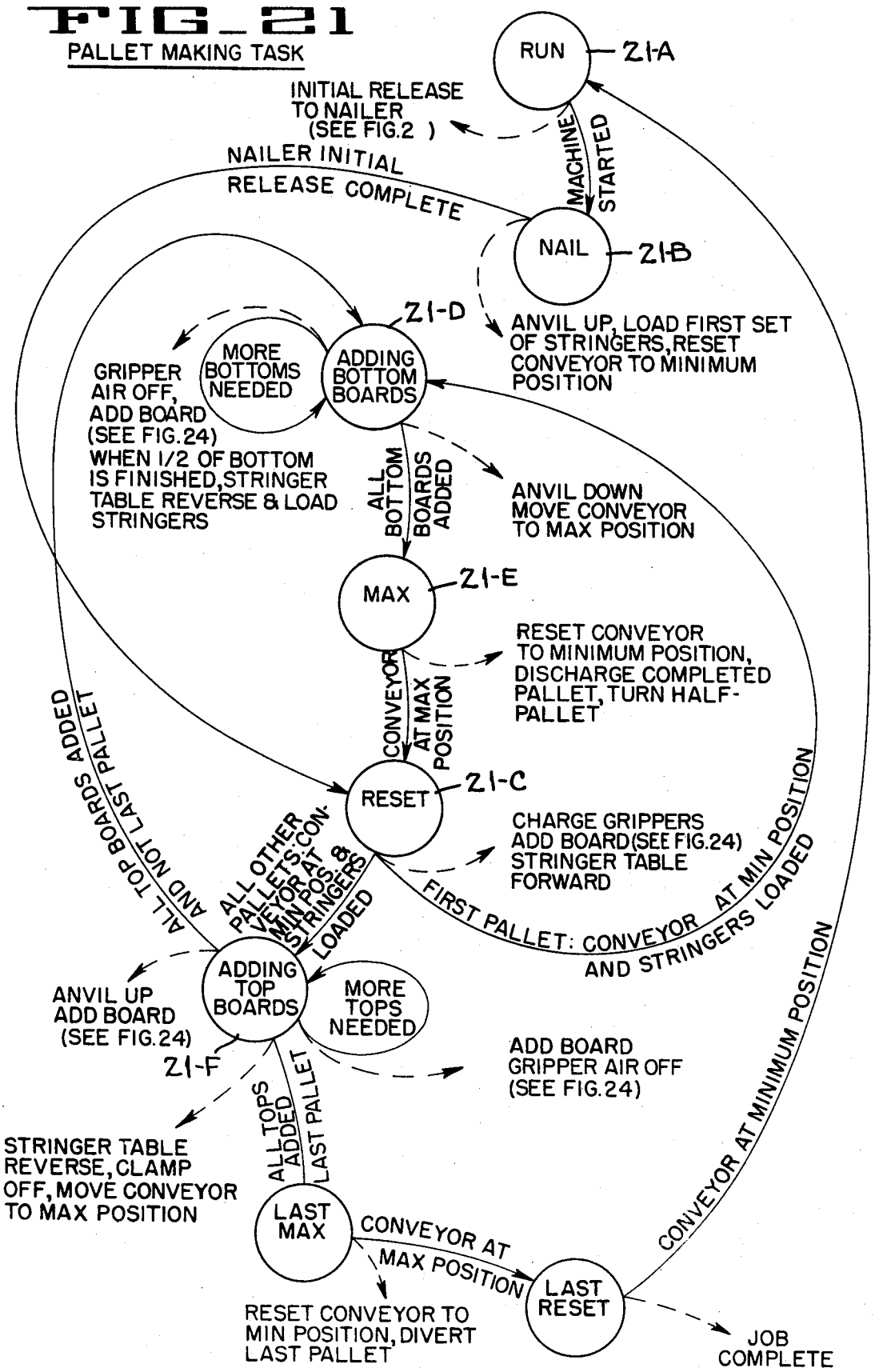
FIGS. 21–25 are state diagrams showing the program for controllin the operation of the machine.
Figure 22:
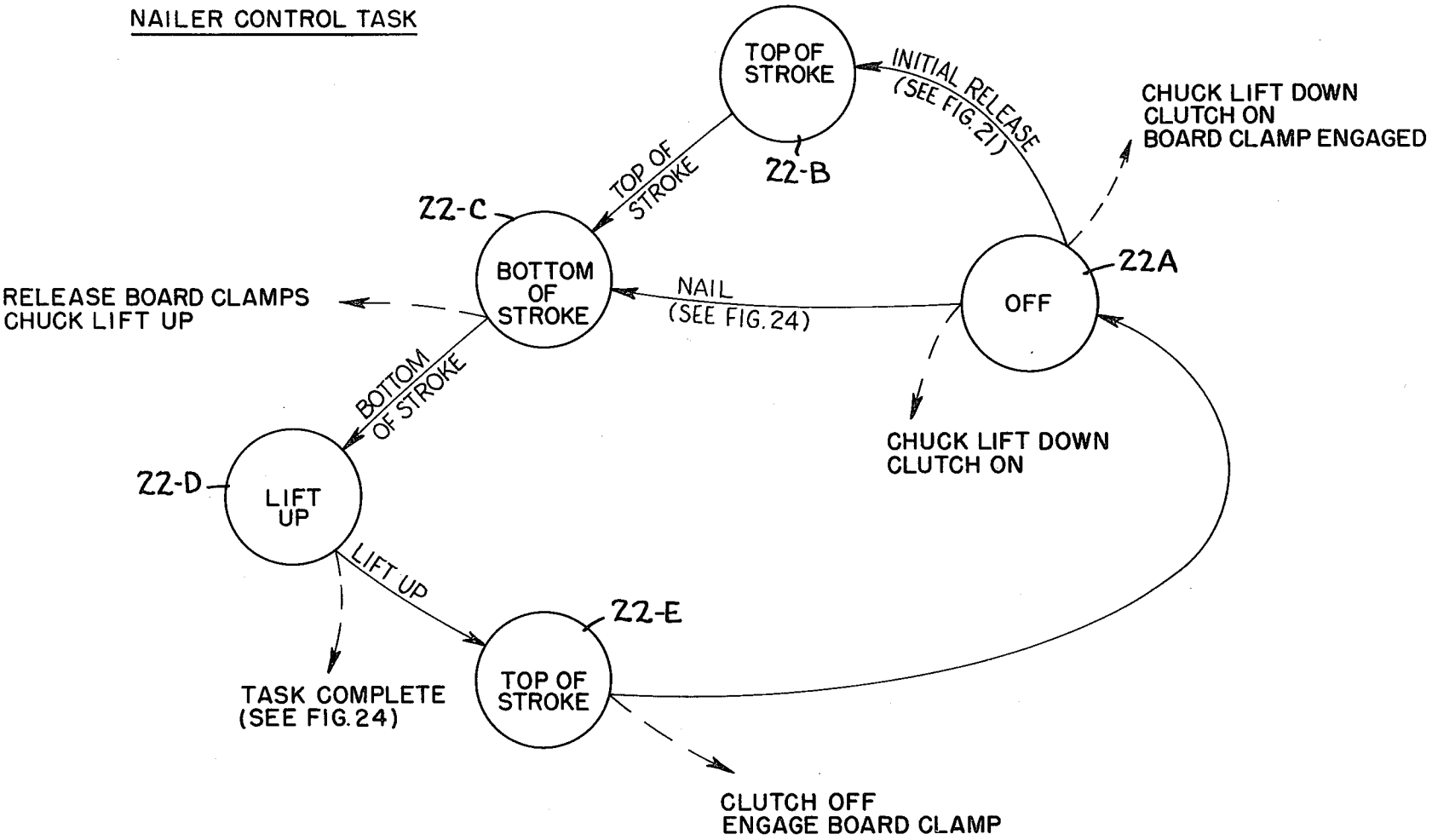
Figure 23:
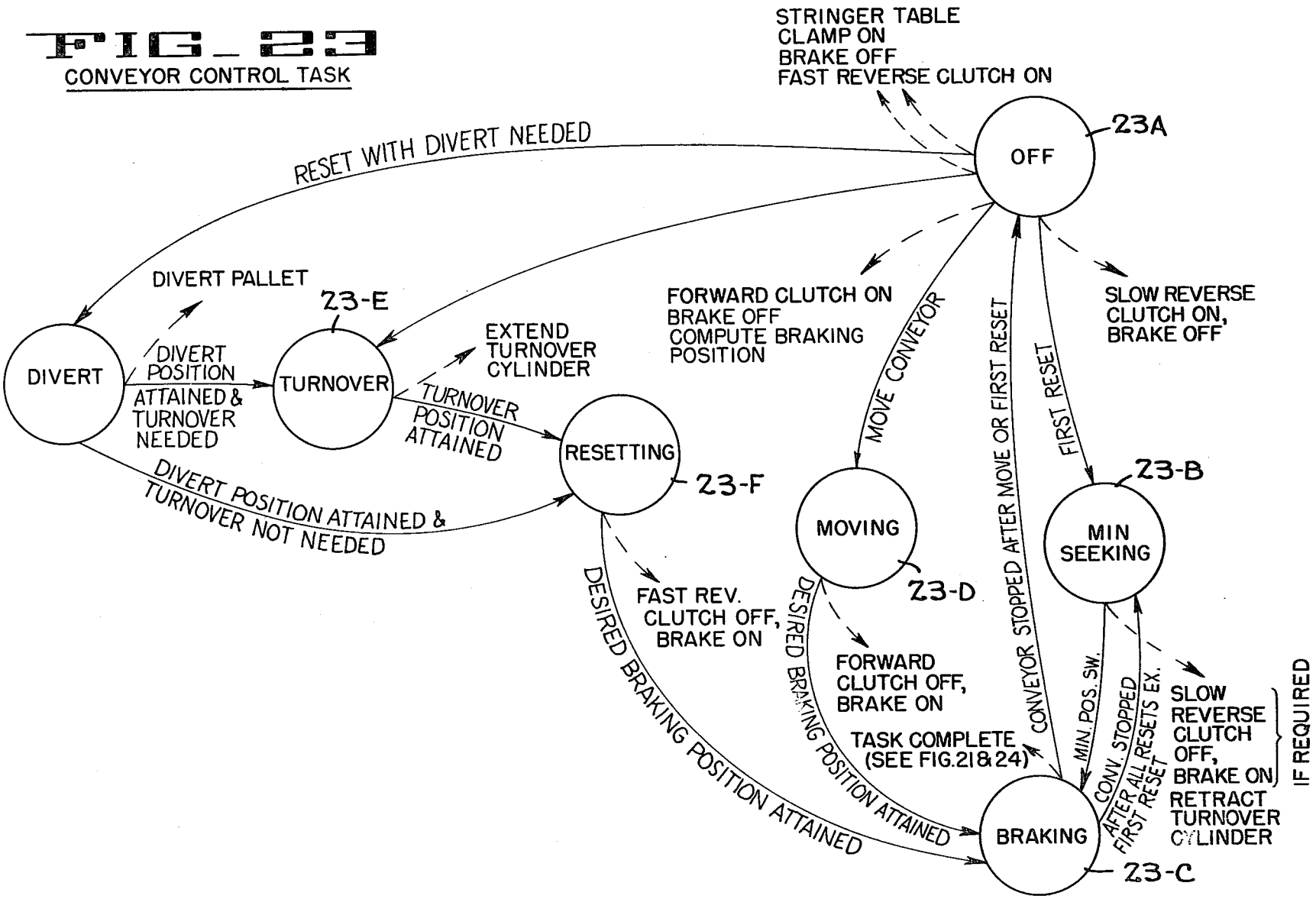
Figure 24:
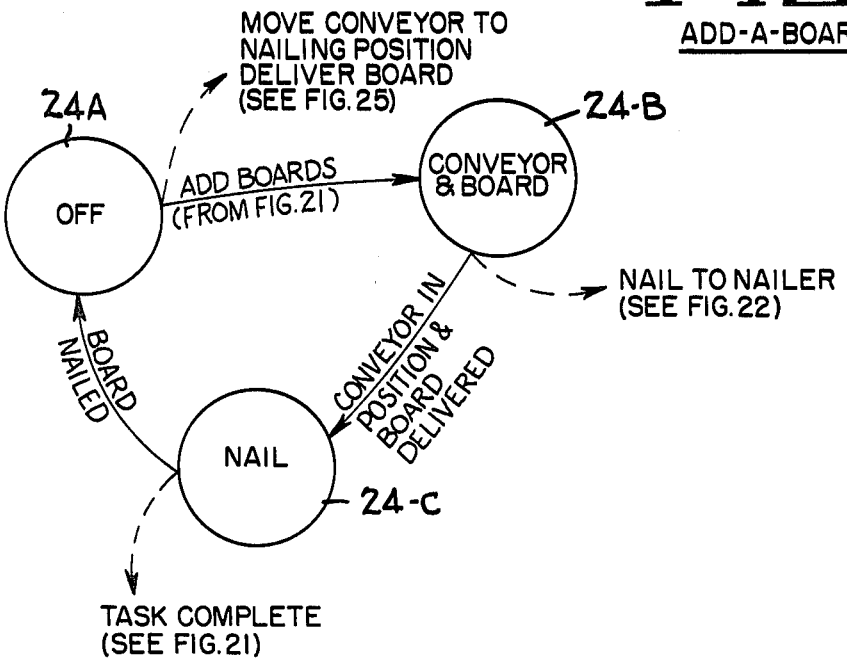
Figure 25:
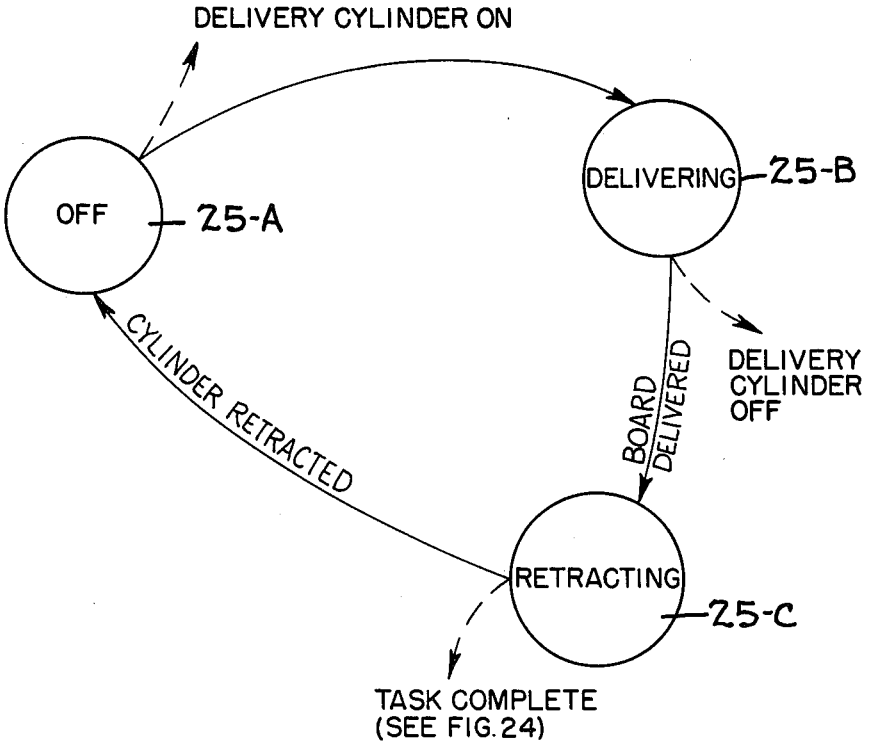

FIG. 21 shows the Pallet Maker task; FIG. 22 indicates the Nailer Control task; FIG. 23, the Gripper Conveyor Control task; FIG. 24, the Add-a-Board task; and FIG. 25, the Deckboard Delivery task. After a valid specification has been entered into the machine, the Pallet Maker task controls the repetitive pallet making process. The other tasks react to instructions from the Pallet Maker and, in some instances, the other tasks interact with each other.

The specification for a pallet-making operation includes the number of pallets to be made, the number, location, and size of deckboards on the top surface of each pallet, the number of deckboards to be nailed on the bottom of each pallet and the number of stringers to be utilized.

It will be understood that, before the machine is turned on, its various electrically-driven mechanisms are connected to suitable supplies of electrical power, and air under suitable pressure is supplied to the header 275.

After a valid specification has been entered into the machine, a "reset" message is sent to the Pallet Maker that power has been turned on. The Pallet Maker takes the following steps: the deckboard number is set to zero; the pallet number is set to zero; valves V2 and V3 are actuated to turn off the air to the air chucks 121; and valve V8 is actuated to lower the anvil 186. The Pallet Maker is now in state 21-A, identified as the Run state.

When the Pallet Maker receives a message that the machine has started, it sends a request to the Nailing Control task to make an initial release of nails, and the Pallet Maker shifts to state 21-B to await the completion of the initial release operation.

When the Nailing Control task (FIG. 22) (referred to hereinafter as the NCT) receives the initial release request, it is in state 22-A and the nailing chucks are in a lowered position. During this initial operation, the nailer is cycled once to clean out the nail chucks and locate the top of the nailing head stroke. The NCT first actuates the clutch-brake 207 (FIG. 20) to release the brake and engage the clutch to connect the continuously operating motor M1 to the crank 203 to initiate the rotation of the crank. Also, it actuates valves V6 and V7 to deliver air to cylinders 231 to move the clamps 230 inwardly to await the delivery of a deckboard. Meanwhile, the NCT has shifted to state 22-B to await the arrival of the nailing head at the top of its stroke. When the top of the stroke is reached, the NCT shifts to state 22-C to await the arrival of the nailing head at the bottom of its stroke. During the downward movement of the nailing head, the punches 201 are moved through the chucks to clean out any nails that might be in the chucks, and the rotary picking heads of the machine are actuated to drop a new set of nails into the funnels for delivery to the chucks to temporarily rest against the shanks of the punches in the chucks. When the nailing head is at the bottom of its stroke, the NCT actuates valves V6 and V7 to move the deckboard clamp to their outer position, actuates valves V9 and V12 to start the upward movement of the chucks, while shifting to state 22-D to await the completion of these operations.

As the nailing head moves upwardly, the plungers are moved upwardly in the chucks to permit the new set of nails for the first bottom deckboard of the first half-pallet to drop into the chucks. When these actions are completed, NCT moves to state 22-E to await the arrival of the nailing head at top position. When the top position is reached, NCT shifts to state 22-A and actuates the clutch-brake 207 to disconnect the clutch and apply the brake to stop the rotation of the crank 203, and engages the deckboard clamp in anticipation of the board delivery. When the initial release cycle is completed, NCT sends a signal to the Pallet Maker task (PMT) that the initial release has been completed.

The Pallet Maker task (PMT), which has been in state 21-B awaiting the completion of the initial nail release, now shifts to state 21-C, raises the anvil, and sends a message to the Conveyor Control task (CCT) to move the gripper carriage shaft to the minimum position which is position P2 at which the gripper heads engage the set of stringers that have been positioned by the operator on the stringer carriage. Conveyor Control task (CCT) (FIG. 23) is, at this time, in state 23-A. When the signal is received from PMT, CCT actuates unit 285 (FIG. 20) to release the brake and apply the clutch to move the upper run of the chain and the gripper carriage connected to the chain toward the minimum position, while shifting to state 23-B. When the gripper carriage shaft reaches the minimum position, CCT shifts to state 23-C while actuating valve V-11 to swing the turn-over bar 29 to upright position (if required), and disengaging the clutch and applying the brake of unit 285 to stop the gripper carriage shaft at the minimum position. It should be noted that, as the gripper carriage reaches the minimum position, the latch 136 on the carriage automatically engages the latch bar 137 on the stringer carriage.

When the conveyor has come to a complete stop, CCT shifts to state 23-A while sending a message to the Pallet Maker task (PMT) that the gripper conveyor is at the minimum position, and advising PMT to turn on the air to the air chucks 121.

PMT, which has been waiting in state 21-C, actuates valve V1 to actuate air motor 53 in a direction to assist the forward movement of the stringer carriage that is latched to the gripper carriage, actuates valves V2 and V3 to direct air to the air chucks to cause the gripping heads to grip the stringers, sends a message to the Add-a-Board task (AAB) to position and nail a deckboard on the set of stringers engaged by the grippers, and moves to state 21-D to await the completion of the first deckboard nailing operation. AAB (FIG. 24), which is in state 24-A, sends a message: (a) to CCT to move the gripper carriage forwardly to position the section S-1 of the stringers at the nailing position P3 under the nailing chucks; (b) to Deckboard Delivery task (DDT) to deliver a deckboard to the top surface of the stringers at the nailing position; and (c) shifts to state 24-B to await the completion of these operations. CCT actuates the forward clutch-brake unit 286 to release the brake and apply the clutch to move the gripper carriage forwardly, while shifting to state 23-D. When the desired position is reached as indicated by a count from a shaft encoder 299, CCT shifts to state 23-C, and actuates clutch-brake unit 286 to disengage the clutch and apply the brake. The air motor 53 remains on, tightly holding the stringers between the gripper carriage and the stops on the ends of each of the plates 20*e*–20*h* of the stringer carriage, as seen in FIG. 2. When the conveyor is stopped, CCT sends a message to AAB that the conveyor-positioning operation has been completed, and CCT shifts to state 23-A.

Since the gripper carriage is at the first bottom board nailing position AAB energizes solenoid 138 to release the latches 136–137.

DDT, which is in state 25-A (FIG. 25) when it receives the message from AAB, actuates valves V4 and V5 to cause cylinders 170 to move the stripper bars 165 forwardly, and shifts to state 25-B to await the positioning of the board at the nailing position. As the stripper bars move forwardly the lowermost board in the hopper is engaged and moved forwardly to the nailing position where it is received between the inner ends of the deckboard clamps 230 which are, at this time, in their innermost position. DDT then actuates valves V4 and V5 to cause cylinders 170 to retract the stripper bars and shifts to state 25-C. As the bars move rearwardly, the deckboard remains gripped by the deckboard clamps and a new deckboard moves down onto the upper surfaces of the stripper bars. When the stripper bars have been retracted, DDT shifts to state 25-A and sends a message to AAB that a deckboard is in position.

AAB, which has been waiting in state 24-B, now sends a message to NCT to nail the deckboard onto the stringers and shifts to state 24-C to await the completion of the nailing. NCT, which is at state 22-A (FIG. 22), actuates valves V9 and V10 to cause cylinders 193 to lower the nailing chucks, and actuates the clutch-brake 207 to release the brake and engage the clutch to move the nailing head, which is in its upper position, through one 360° cycle, and shifts to state 22-C to await the arrival of the nailing head at its bottom, 180° position. During downward movement of the nailing head, the punches drive the nails in the chucks downwardly into the stringers against the upward pressure of the anvil 186. When the bottom of the stroke is reached, NCT actuates valves V6 and V7 to release the deckboard clamps 230, actuates valves V9 and V10 to raise the chucks and shifts to state 22-D to wait for the chucks to be raised. When the chucks have been raised, NCT sends a message to AAB to the effect that the first deckboard has been nailed and shifts to state 22-E to await the arrival of the nailing head at the top of its stroke. When the head reaches the top position, NCT actuates valves V6 nd V7 to move the clamps 230 to their inner position and actuates the clutch-brake 207 to disengage the clutch and apply te brake to stop the nailing head at the top, 360° position and shifts to state 22-A to await the arrival of the next 'nail' message at which time the above operations will be replicated religiously.

When AAB gets the word from NCT that nailing is complete, it shifts to state 24-A to await the next add-board request, and tells PMT that the board has been added. PMT, which remains in state 21-D, turns off the air to the air chucks 121. PMT activates valves V2 and V3 to stop the flow of air to the chucks. The gripper heads are for sure by now fully charged with air, causing them to maintain a firm grip on the two outside stringers until they are released. Simultaneously, PMT since it has been programmed to nail three bottom deckboards, again sends a message to AAB to position and nail another deckboard on the stringer set.

AAB again sends a message to the Conveyor Control task (CCT) to advance the gripper cariage to position sections S-3 ofthe stringers at the nailing position and sends a message to DDT to deliver a deckboard to the nailing position.

DDT, which is in state 25-A, goes through its procedure from state 25-A to 25-B to 25-C and back to state 25-A, as explained above, to deliver the deckboard, return the stripper bars to their retracted position, and send a message to AAB that the board is in positon. AAB sends a message to the Nailing Control task (NCT) to nail the deckboard to the stringers. NCT, which is in state 22-A (FIG. 22), goes through its procedure, shifting from state 22-A to state 22-C, then to state 22-D, then to state 22-E and finally back to state 22-A, and during the procedure, it causes the nailing chucks to be lowered, the nailing head to be driven through a 360° cycle, causing the nail picks to drop a new set of nails into the chucks behind the downwardly moving punches, the punches to drive nails through the deckboard and into the stringers as explained above. During this procedure, when the head reaches its lower 180° position, the deckboard clamps 230 are moved to their outer positions, and the nailing chucks are raised and, when the head reaches its upper 360° position, the deckboard clamps are again moved to their inner position and NCT sends a message to AAB to the effect that the second deckboard has been nailed. AAB informs PMT that this task is comlete and PMT responds by returning the stringer table to the loading position and by telling AAB to add another board (the third and last BB of the deck).

AAB again starts the deckboard delivery, positioning and nailing operation explained above in connection with the first and second deckboards. When the third deckboard has been nailed, AAB sends a message to the Pallet Maker task (PMT) (FIG. 21). which is in state 21-D, that the board has been added. Since PMT knows that the operation completes the first half-pallet, PMT actuates valve V8 to allow the anvil to move to its lower position. It then sends a message to the Conveyor Control task (CCT) (FIG. 23) to move the gripper carriage to the maximum position P5, and shifts to state 21-E to wait for the carriage to reach P5. CCT computes the braking position for the maximum position, then actuates the forward clutch-brake unit 286 to release the brake and engage the clutch to move the gripper carriage forwardly and shifts to state 23-D to await the attainment of the braking position. CCT shifts to state 23-C and actuates the forward clutch-brake unit 286 to disengage the clutch and apply the brake when the braking position has been reached. When the gripper carriage has completely stopped at the maximum position, CCT shifts to state 23-A while sending a message to the Pallet Maker task (PMT) that the carriage is at the maximum position.

PMT, which is in state 21-E, sends another message to the Conveyor Control task (CCT) (FIG. 23) instructing it to reset the gripper carriage shaft to the minimum position. CCT shifts from state 23-A to state 23-E, and sequentially actuates reverse clutch-brake 285 to release the brake and engage the clutch to move the gripper carriage toward the minimum position, and de-energizes solenoids 139 to allow the latch levers 137 to swing back to a position to be engaged and latched by latch bars 136 on the gripper carriage. When the gripper carriage arrives at turn-over position P4, CCT actuates valve V11 to extend the turn-over bar 29 to aid in inverting the half-pallet, computes the braking position for the minimum position and shifts to state 23-F. When the braking position for the minimum position is reached, CCT shifts to state 23-C and actuates the reverse clutch-brake unit 285 to disengage the clutch and apply the brake. When the conveyor has completely stopped and the minimum position attained, CCT actuates valve V11 to swing the turn-over bar back to upright position, shifts to state 23-A and sends a message to the Pallet Making task (PMT) that the gripper carriage is at the minimum position and instructs PMT to direct air to the air chucks 121. PMT actuates valves V2 and V3 to charge the chucks, causing the gripping heads to grip the new stringers, then actuates valve V1 to actuate air motor 53 in a direction to assist the forward movement of the stringer carriage, and sends an add board message to AAB and shifts to state 21-F. AAB again starts the deckboard delivery, positioning and nailing operation explained above in connection with the three bottom boards. As each top board is nailed, AAB sends a message to Pallet Maker task (PMT) which is in state 21-F that the board has been added. When PMT determines that all five top boards have been added, completing the first full pallet, valve V-8 is actuated to raise the anvil, PMT shifts to state 21-D and sends an Add-a-Board message to AAB. AAB responds in the manner previously described to now add the first bottom board of the next half-pallet and this half-pallet is made in the manner previously described for the first half-pallet. The gripper carriage is now moved to the maximum position. The gripper carriage engages abutments 134 to vent the gripper heads that engage the fullpallet, thereby releasing the pallet. CCT performs exactly the reset operations previously described except that it shifts to state 23-G and, when divert position is attained, CCT sends a divert-pallet message to take-away conveyor 35 to discharge the full pallet. CCT shifts to state 23-E and continues the reset procedure previously described.

The above procedures for forming pallets are carried out over and over until the desired number of pallets are fabricated. When the next-to-last full pallet has been discharged, the gripper carriage in its return to the minimum position with the last half-pallet trailing it, does not pick up any new stringers. The top boards are nailed on the half-pallet and it is moved to the maximum position where it is discharged. The conveyor is sent to minimum position. Along the way, the turn-over mechanism bar is operated even though no half-pallet is present for turning.

The machine is shut down and PMT shifts to state 21-A waiting for the machine to be operated again.

What is claimed is:

1. An apparatus for making pallets comprised of spaced parallel stringers and several deckboards nailed to opposite sides of the stringers in spaced parallel relation and at right angles with the stringers, said apparatus comprising:

means located at a nailing station for consecutively nailing deckboards to a plurality of spaced parallel stringers;

means for intermittently conveying said plurality of spaced parallel stringers from a loading station forwardly toward the nailing station and thereafter in stepped relation through the nailing station to permit deckboards to be consecutively nailed to the stringers to form a half-pallet; and means for inverting the half-pallet assembly so that deckboards may be nailed to the other sides of the stringers of the half-pallet assembly, said inverting means including means for releasably and firmly grasping one end of the half-pallet assembly, means for rotatably mounting said grasping means to said means for conveying the stringers to permit the grasping means to rotate the half-pallet assembly about an axis that is transverse to its direction of travel as the half-pallet assembly, and means that engage the free opposite end of the half-pallet assembly for pivoting the half-pallet assembly 180° about said transverse axis of rotation as said grasping means is moved by said conveying means.

2. The apparatus for making pallets according to claim 1 wherein said means for engaging the free end of the half-pallet assembly comprises an inverter bar, and means for pivoting said inverter bar about an axis that is parallel to the axis of rotation of said grasping means in timed relation with the movement of the grasping means.

3. The apparatus for making pallets according to claim 2 wherein said inverter bar includes a tip which is proximal the half-pallet assembly that is positioned to slidably engage the underside of the leading deckboard of the half-pallet assembly and an elongate surface over which said leading deckboard is adapted to slide.

4. The apparatus according to claim 1 wherein said means for engaging the free end of the half-pallet assembly is positioned on the opposite side of said nailing station from said means for consecutively feeding deckboards to the stringers.

5. The apparatus according to claim 1 wherein said conveying means is adapted to convey the half-pallet assembly a distance from said nailing station that is substantially longer than the length of the half-pallet assembly, and wherein said means for engaging the free end of said half-pallet assembly is adapted to pivot the half-pallet assembly away from said nailing station as the half-pallet assembly is returned toward said nailing station.

6. The apparatus for making pallets according to claim 5 wherein said conveying means further includes second means for grasping a separate plurality of stringers, means for rotatably mounting said second means to said conveyor, said nailing means including a first anvil mounted at a fixed height supporting the inverted half-pallet assembly at said nailing station, and a second anvil and means for moving said second anvil between a position that is no higher than the height of said first anvil to an elevation spaced above said first anvil by the thickness of a deckboard to thereby support a plurality of stringers at said nailing station, said first-mentioned grasping means and said second grasping means being capable of simultaneously moving an inverted half-pallet and empty stringers through said nailing station.

7. The apparatus for making pallets according to claim 6 wherein said conveyor further includes a carriage separate from said first-mentioned and said second grasping means, means on said carriage for supporting a plurality of stringers in a position to be grasped by said grasping means and at a height aligned with said elevated position of said second anvil, and means for driving said carriage forwardly with said conveyor from said loading station to a position spaced closely apart from said nailing station, and wherein said first and second grasping means are both adapted to grasp striners on said carriage when either of said grasping means are empty and while te other one thereof is engaging an inverted half-pallet.

8. The apparatus for making pallets according to claim 7 for further including means for automatically opening the one of said grasping means that is engaging a complete pallet assembly after the complete assembly has been moved beyond said pallet free end engaging means, and means for actuating said grasping means to close upon the stringers on said carriage when the grasping means is brought into alignment with the ends of the stringers.

9. The apparatus for making pallets according to claim 8 wherein said first and second grasping means are mounted for simultaneous rotation to said conveyor so that as the half-pallet assembly is inverted, the other grasping means is brought into an orientation adapted to engge the opposing ends of the stringers on the carriage.

10. The apparatus according to claim 5 wherein said means for engaging the free end of a half-pallet assembly includes an inverter bar and means for pivoting said inverter bar in synchronization with the movement of said conveyor, said inverter bar including a tip end that is adapted to engage the underside of the leading deckboard of the half-pallet assembly as it is conveyed toward said nailing station and an upper surface adapted to slidably engage the deckboard, and a pawl mounted to said tip end so that the pawl may be deflected by the deckboards previously nailed to a pallet assembly and so that the pawl will rigidly engage the leading end of a deckboard of a half-pallet assembly as it is returned toward the nailing position.

11. The apparatus according to claim 2 and further comprising means attached to said inverter rail for supporting the leading end of a pallet assembly after the half-pallet assembly has been pivoted beyond the vertical and until the pallet asembly has been brought to a nearly completely inverted orientation.

12. The apparatus according to claim 11 wherein said supporting means comprises a straight support rail that extends from said inverter rail at an acute angle with the inverter rail, said means for pivoting said inverter rail being adapted to stop the pivoting of the inverter rail when the outer end of the support rail is positioned closely above the conveyor to thereby permit the free end of the half-pallet assembly to slide from the support rail gently onto the conveyor.

* * * * *